US005651192A

United States Patent [19]

Horwitz

[11] Patent Number: 5,651,192

[45] Date of Patent: Jul. 29, 1997

[54] INFRARED TEMPERATURE SENSING FOR TUMBLE DRYING CONTROL

[75] Inventor: Steven A. Horwitz, Bryan, Ohio

[73] Assignee: White Consolidated Industries, Inc., Cleveland, Ohio

[21] Appl. No.: 674,025

[22] Filed: Jul. 1, 1996

[51] Int. Cl.[6] ..... F26B 13/10

[52] U.S. Cl. ..... 34/529; 34/606; 219/494; 236/78 D

[58] Field of Search ..... 34/487, 491, 495, 34/497, 529, 558, 565, 570, 574, 575, 60, 604, 606; 219/711, 494, 510; 236/15 BR, 11, 78 D, 1 EB; 432/58; 137/497, 505.19

[56] References Cited

U.S. PATENT DOCUMENTS

| | | | |
|---|---|---|---|
| 3,116,982 | 1/1964 | McIlvanine | 34/529 |
| 3,583,688 | 6/1971 | Fuqua et al. | 34/495 X |
| 4,286,134 | 8/1981 | Nakata et al. | 219/10.55 B |
| 4,393,858 | 7/1983 | Mori et al. | 236/15 BR X |
| 4,831,747 | 5/1989 | Roos et al. | 34/565 |
| 4,886,680 | 12/1989 | Tindall | 427/8 |
| 5,135,122 | 8/1992 | Gross et al. | 219/10.55 A |
| 5,196,830 | 3/1993 | Birging et al. | 340/584 |
| 5,347,727 | 9/1994 | Kim | 34/491 |
| 5,351,417 | 10/1994 | Rubin | 34/90 |
| 5,396,715 | 3/1995 | Smith | 34/494 X |
| 5,405,475 | 4/1995 | Kraft et al. | 156/275.5 |
| 5,454,171 | 10/1995 | Ikeda et al. | 34/491 X |
| 5,544,428 | 8/1996 | Kuroda et al. | 34/491 X |

*Primary Examiner*—John M. Sollecito
*Assistant Examiner*—Steve Gravini
*Attorney, Agent, or Firm*—Pearne, Gordon, McCoy & Granger LLP

[57] ABSTRACT

Disclosed is a dryer device and a drying control system utilizing an infrared sensor that measures the temperature of garments or items being dried in a drying device. The invention provides significant improvement over conventional techniques using temperature sensors, or such sensors in combination with moisture or humidity sensors. Also disclosed are methods for controlling drying temperatures and methods for determining drying cycle completion.

13 Claims, 5 Drawing Sheets

INFRARED TEMPERATURE SENSING FOR TUMBLE DRYING CONTROL

FIELD OF THE INVENTION

The present invention relates to infrared temperature sensing for drying devices, and particularly for clothes dryers.

BACKGROUND OF THE INVENTION

Poorly controlled or inaccurate control systems for clothes dryers can lead to burnt or scorched garments, or underdried garments. Typically, such conditions result from inadequate measurement of drying temperatures.

In an attempt to achieve better drying results, prior artisans have utilized moisture sensors, usually in combination with other sensors, to determine when a drying cycle is complete. Alternately, or in addition, prior art dryer systems have utilized a timer which is set according to characteristics of the dryer load. Unfortunately, neither of these techniques enables accurate measurement of drying temperatures. And so, burnt or underdried garments still result. Thus, there is a need for a system enabling more accurate measurement of drying temperature, and particularly the temperature of the garments themselves, to avoid the prior art problems of overdrying and underdrying.

Inaccurate measurement of drying temperature also leads to energy waste when the drying device runs longer than necessary. This is of significant importance in view of increasing environmental concerns and rising energy costs. This creates an additional need for a system that accurately monitors drying temperatures to minimize dryer operating costs and energy waste.

SUMMARY OF THE INVENTION

The present invention achieves all of the foregoing objectives and provides a dryer comprising an infrared sensing device that measures and indicates the temperature of articles in the dryer. Specifically, the present invention provides a rotatable drum dryer comprising an infrared sensing device that provides either an analog or digital signal representative of the temperature of articles in the dryer. The infrared sensing device may also provide a visual indication of the temperature of articles in the dryer. Also encompassed within the present invention is a rotatable drum dryer utilizing two such infrared sensing devices.

The invention further provides a dryer control system comprising an infrared sensing device in combination with other sensors. In particular, the present invention provides a control system utilizing the infrared sensing device in combination with a temperature sensor exposed to air in the dryer inlet or a temperature sensor exposed to air in the dryer outlet, and optionally, a second infrared sensing device.

Also provided by the present invention are methods for determining drying cycle completion utilizing infrared measurement of articles being dried. The methods for determining drying cycle completion include comparing the rate of temperature increase of articles in the dryer with one or more preset or predetermined values. Also included is a technique in which the temperature of articles in the dryer is compared to a preset temperature value.

The invention further provides a method for controlling drying temperature by comparing the temperatures of articles in the dryer and dryer exhaust with predetermined setpoint values and idealized time curves. The invention provides another method for controlling drying temperatures by use of a ratio of two drying parameters determined from a particular combination of measurement inputs.

DESCRIPTION OF THE PREFERRED EMBODIMENTS

Figure 1:
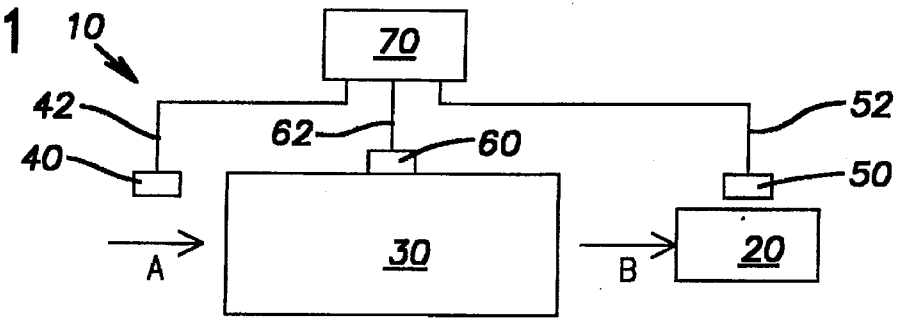
FIG. 1 is a schematic illustrating the major components of the temperature sensing system of the present invention.

FIG. 1 illustrates a preferred embodiment drying system 10 in accordance with the present invention generally comprising a dryer unit 30, a blower unit 20, a dryer air inlet temperature sensor 40, a dryer air outlet temperature sensor 50, one or more infrared sensors 60, and a dryer control unit 70. The blower unit 20 generates and draws airstream A through a dryer air inlet as known in the art to the dryer 30. The entering air passes over articles in the dryer whereby moisture is removed from the articles. Airstream B exits the dryer 30 and the blower unit 20 through one or more exhaust outlets as known in the art. The dryer 30 includes provisions for heating the inlet airstream A and/or the dryer interior, and for receiving and tumbling moist or wet articles such as in a rotatable drum or basket. Typically, the blower 20 is downstream of the drum and a heater is upstream of the drum. Thus, the blower 20 draws heated air into and through the drum.

The inlet temperature sensor 40 measures the temperature of the inlet airstream A and provides one or more control signals to the controller 70 via a signal line 42. Similarly, the outlet temperature sensor 50 provides a measurement of the temperature of the outlet air in airstream B through a signal line 52 to the controller 70. Typically, the outlet temperature sensor 40 is disposed at an output from the blower 20, or within the housing of the blower 20.

The infrared sensor 60 is preferably disposed at or immediately adjacent the container or drum of the dryer 30 containing the articles or garments to be dried as explained in greater detail below. The sensor 60, as also explained in greater detail below, provides an indication or measurement of the actual temperature of garments in the dryer 30. The sensor 60 preferably provides one or more control signals to the controller 70 through a signal line 62. The control signals correspond to the temperature of the articles in the dryer. The control signals may be either analog or digital. The infrared sensor 60 is preferably disposed such that its sensing field or view is exposed to the maximum surface area of garments residing in the dryer. In many applications involving drum dryers, the sensor 60 is mounted along the axis of rotation of the drum. In such an embodiment, the sensor 60 can be mounted directly on the dryer door, such as by replacing a dryer door window port with a panel containing the infrared sensor 60. It is also contemplated that the sensor 60 may be mounted along other regions of a dryer providing a view of the interior of the dryer drum and of the garments disposed therein.

It is important to note that the infrared sensors 60 do not measure air temperature within dryer 30. Instead, the sensors measure actual surface temperatures of the garments being dried.

A wide array of commercially available infrared sensors may be used in the present invention. The preferred sensor is an EXERGEN Model IRT\C.2—140° F.\60° C. Other comparable sensor units are also acceptable. It is preferred that the infrared sensor have an accuracy within at least two percent at 80° F. to 180° F., and at least five percent accuracy in the temperature range of 50° F. to 220° F. The infrared sensor selected should also have high durability to vibration and high temperatures.

It is further contemplated that an infrared temperature sensing device could be incorporated into a dryer and provide a visual indication of the temperature of the garments being dried. The device could provide both a visual indication, i.e. an analog or digital display of temperature, and one or more control signals, analog or digital, utilized for controlling dryer operation.

Figure 2:
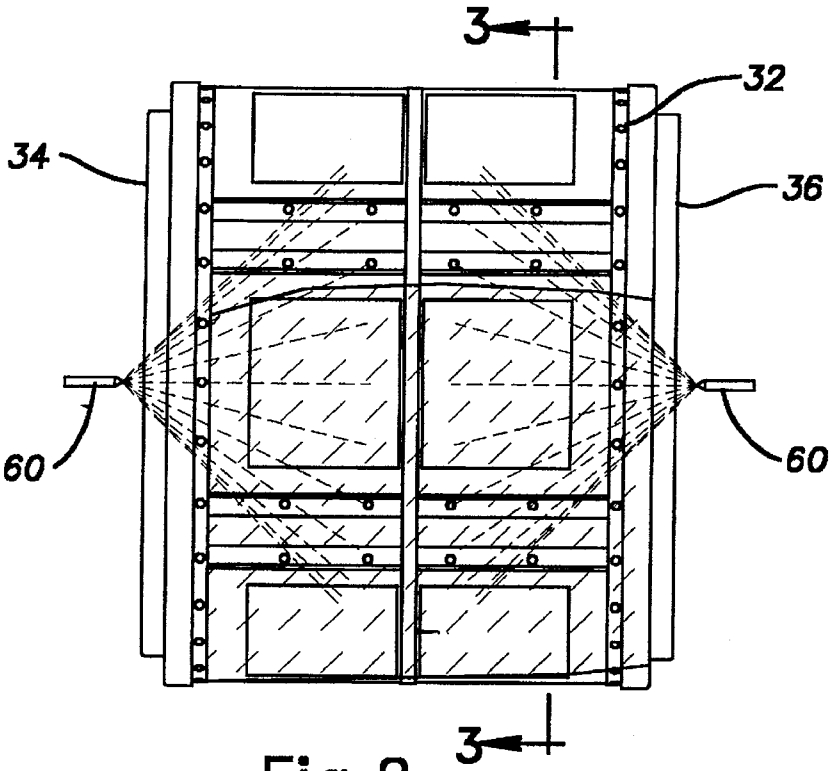
FIG. 2 is an elevational view of a typical dryer drum comprising two infrared temperature sensors in accordance with the preferred embodiment of the present invention.

FIG. 2 illustrates a typical rotatable dryer basket 32 having front and rear faces 34 and 36, respectively. Disposed along at least one of the front and rear faces 34 and 36, is the previously described infrared sensor 60. As noted, the sensor 60 is preferably centrally located along a front or rear face, such as along the axis of rotation of the basket 32, or approximately so. It is most preferred to utilize a second infrared sensor 60, mounted on an opposite face 34, 36 of the basket 32, as shown in FIG. 2.

Figure 3:
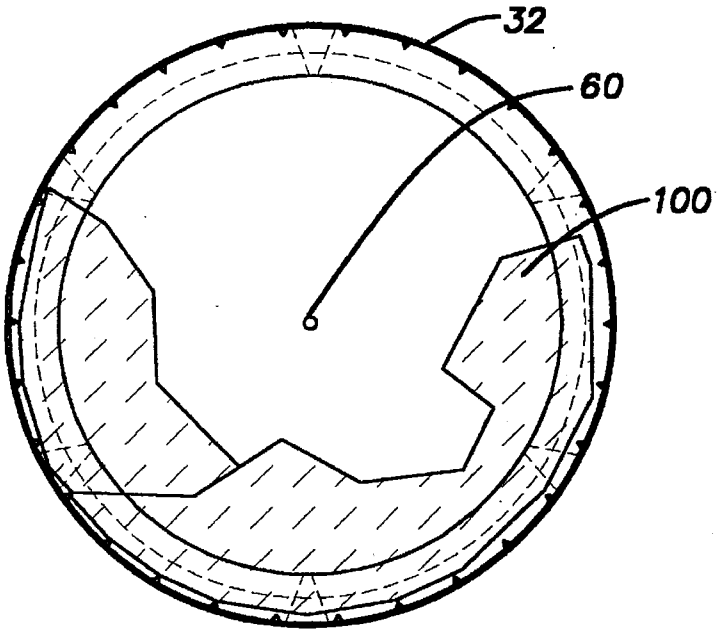
FIG. 3 is a cross-section taken along line 3—3 in FIG. 2, illustrating the sensor view and garments typically disposed within the drying drum.

FIG. 3 is a cross-sectional view of the basket depicted in FIG. 2 and illustrates several garments 100 residing in the basket 32. FIG. 3 illustrates a typical sensor view.

Referring to FIG. 1, the operation of the preferred embodiment drying system 10 is as follows. Wet or moist garments 100 (FIG. 3) are placed in the dryer 30. The blower unit 20 generates and draws inlet airstream A into the dryer 30 to thereby pass the airstream A over the garments 100. Airstream A is typically heated before entry to the dryer drum. The heated air removes water from the garments and exits as outlet airstream B.

The controller 70 monitors and governs the operation of the dryer 30 based upon signals received from one or more infrared sensors 60, and the inlet and/or outlet temperature sensors 40 and 50, respectively. The controller 70 controls the amount of heat introduced and thus the temperature within the dryer 30. The controller 70 governs dryer operation by control schemes described below.

In accordance with the present invention, one of the temperature sensors 40 or 50 can be eliminated if one or more infrared sensors 60 are utilized, while retaining a satisfactory level of accuracy in the dryer control. Utilizing this approach, it has been found that satisfactory degrees of control accuracy are achieved by employing a combination of two infrared sensors 60 and a single dryer outlet temperature sensor 50.

The present invention, in addition to providing the previously noted apparatus and control system, also provides methods for very accurately controlling drying temperature. In a first method, drying temperature is controlled by utilizing a ratio of two drying parameters. The first parameter is the heat supplied to the dryer. The second parameter is the water removed during the drying process. The ratio of heat supplied to the dryer "Q" to the weight amount of water removed "W" has been utilized in the industry to rate the performance of dryers. Since this ratio is actually an indication of the amount of energy supplied to the dryer, regardless of the size and condition of the load to be dried, it is a prime predictor of the temperature that will result from the addition of such heat to the dryer system. This ratio however, as far as is known, has never been utilized in a dryer control scheme. The reason for this is believed to result from the wide range of values for Q/W, and thus inaccuracies, that can result depending upon the variables selected for the calculation of Q and W. Specifically, the present invention provides identification of a particular combination of inputs, i.e. measurements from various temperature and moisture sensors, which enable, with surprising and remarkable accuracy, calculation of the ratio Q/W. once determined, the ratio of Q/W can then be utilized by a dryer controller to either increase or decrease the flow of fuel or gas to the dryer to thereby adjust and control temperature.

It is known from thermodynamics that heat input Q, may be calculated according to the following equation:

$$Q=C_p(T_2-T_1)+w[0.444(T_2-T_1)]$$

where $C_p$ is the specific heat of air (BTU/lb °R.);

$T_1$ is the temperature of air initially (prior to heating by dryer) (°F.);

$T_2$ is the temperature of heated air (°F.); and w is the specific humidity of air (lb $H_2O$/lb dry air).

The heat input Q can be calculated utilizing the temperature of the heating element or burner flame "$T_{in}$" for $T_2$. Q can also be calculated by utilizing the temperature within the drying chamber or drum for $T_2$, which can be arrived at by averaging a plurality of measurements obtained at different locations within the drum, "$T_{avg}$". The ambient air temperature "$T_{amb}$" is utilized for $T_1$. The values for $C_p$ and w are available from know references.

With regard to calculating the amount of water removed W, the following relationship is generally employed:

$$W=\frac{h_1-C_pT_2}{H_{vap}}$$

where $h_1$ is enthalpy of the system initially (BTU/lb dry air;

$C_p$ is the specific heat of air (BTU/lb °R.);

$T_2$ is the temperature of heated air (°F.);

$H_{vap}$ is the average heat of vaporization of water over the range of drying temperatures (BTU/lb air);

$h_1$ can be determined by the relationship:

$h_1=C_pT_1+w_1(1061+0.444\ T_1)$ in which $T_1$ is the initial temperature of the drying air (°F.); and $w_1$ is the specific humidity of the drying air initially (lb $H_2O$/lb dry air).

Numerous combinations of temperature measurements can be utilized in the above noted equations for calculating W. For instance, any one or more of the following could be employed for $T_1$: the temperature of the heating element or burner flame "$T_{in}$"; or the temperature within the drying chamber or drum, which as noted can be arrived at by averaging a plurality of measurements obtained at different locations within the drum, "$T_{avg}$". Similarly, one or more of the following can be used in the above equation for $T_2$: the temperature of the garments being dried, such temperature being determined in accordance with the present invention infrared sensor, "$T_{ir}$"; and the temperature of the air exiting the dryer, "$_{exh}$".

Clearly, it will be appreciated that significant variation can occur in the values of Q/W depending upon how the numerator Q and the denominator W are calculated, and what temperature measurements are employed for $T_1$ and $T_2$ in the calculations. Therefore, if Q/W is used in a dryer control scheme, the behavior and performance of the dryer could vary dramatically.

The present inventor has surprisingly discovered that remarkably accurate determinations of Q/W can be arrived at by employing the following relationship:

$$\frac{Q}{W} = \frac{Q\ (\text{based on } T_{amb} \text{ and } T_{in})}{W\ (\text{based on } T_{avg} \text{ and } T_{ir})}$$

That is, calculating Q based upon the ambient air temperature and the temperature of the burner flame, i.e. $T_{amb}$ for $T_1$ and $T_{in}$ for $T_2$, and calculating W utilizing the average temperature within the drying chamber and the temperature of the garments being dried, such as by utilizing an infrared sensor, i.e. $T_{avg}$ for $T_l$ and $T_{ir}$ for $T_2$, has been found to produce calculated ratios of Q/W within about 5% of actual Q/W ratios, and typically within about 2% of actual. Such accuracy has never been achieved by the prior art, and represents a significant advance in dryer control technology.

A most preferred control scheme for controlling drying temperatures in a dryer utilizes (i) comparison of garment temperature during the drying cycle to a garment temperature setpoint value and also to a first idealized time curve, and (ii) comparison of dryer exhaust temperature during the drying cycle to an exhaust temperature setpoint value and additionally to a second idealized time curve. This scheme is used to operate or proportion a valve on the gas or fuel line to the dryer heater, or electrical control unit on an electrical resistance heating element. This most preferred control scheme requires at least two temperature measurement inputs. The first is a measurement of the garment temperature, such as provided by an infrared sensor, designated as $T_{ir}$. The second is a measurement of the dryer exhaust, designated as $T_{exh}$.

Figure 4:
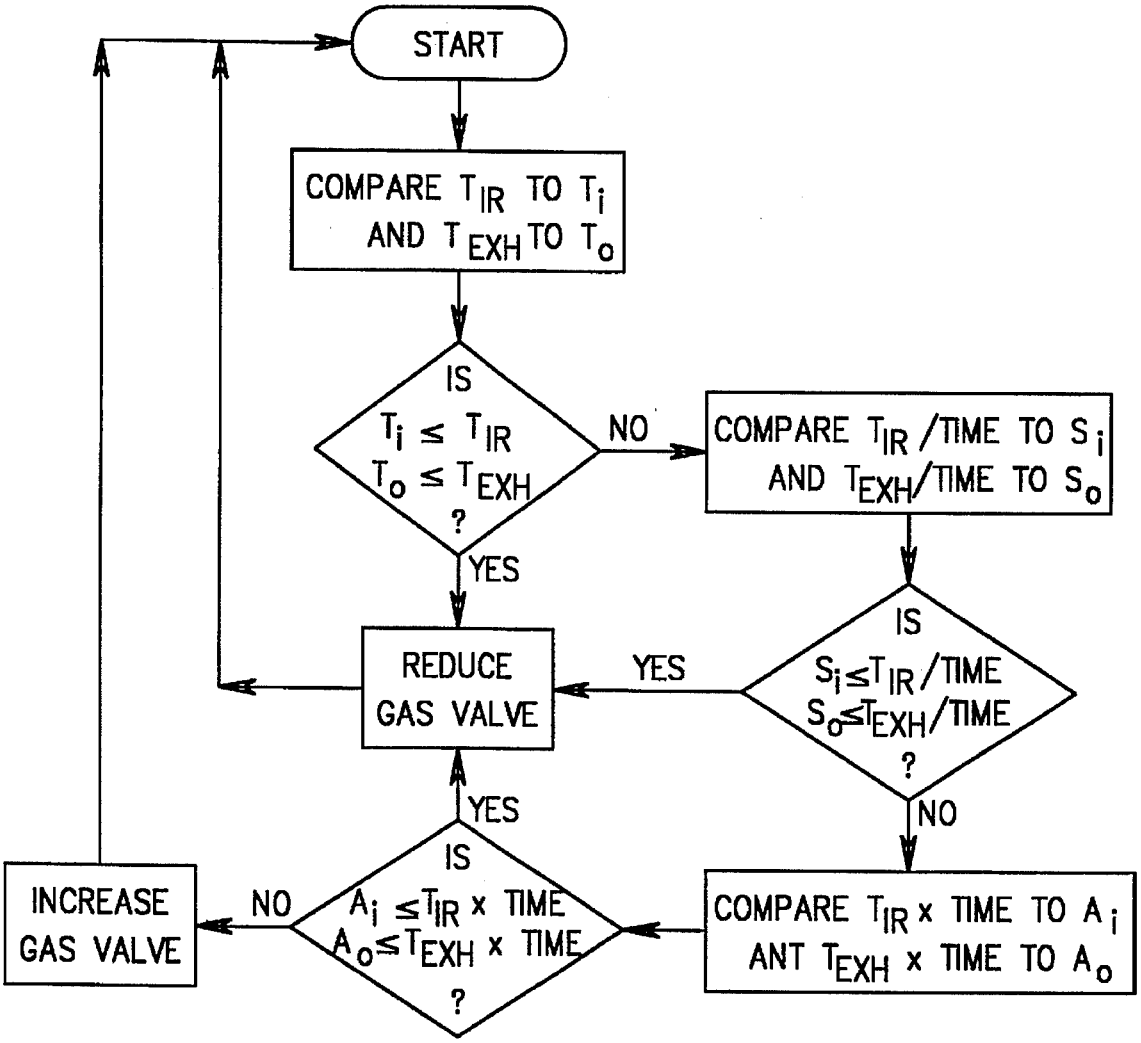
FIG. 4 is a flowchart of a most preferred control scheme in accordance with the present invention for controlling drying temperature.
Figure 5:
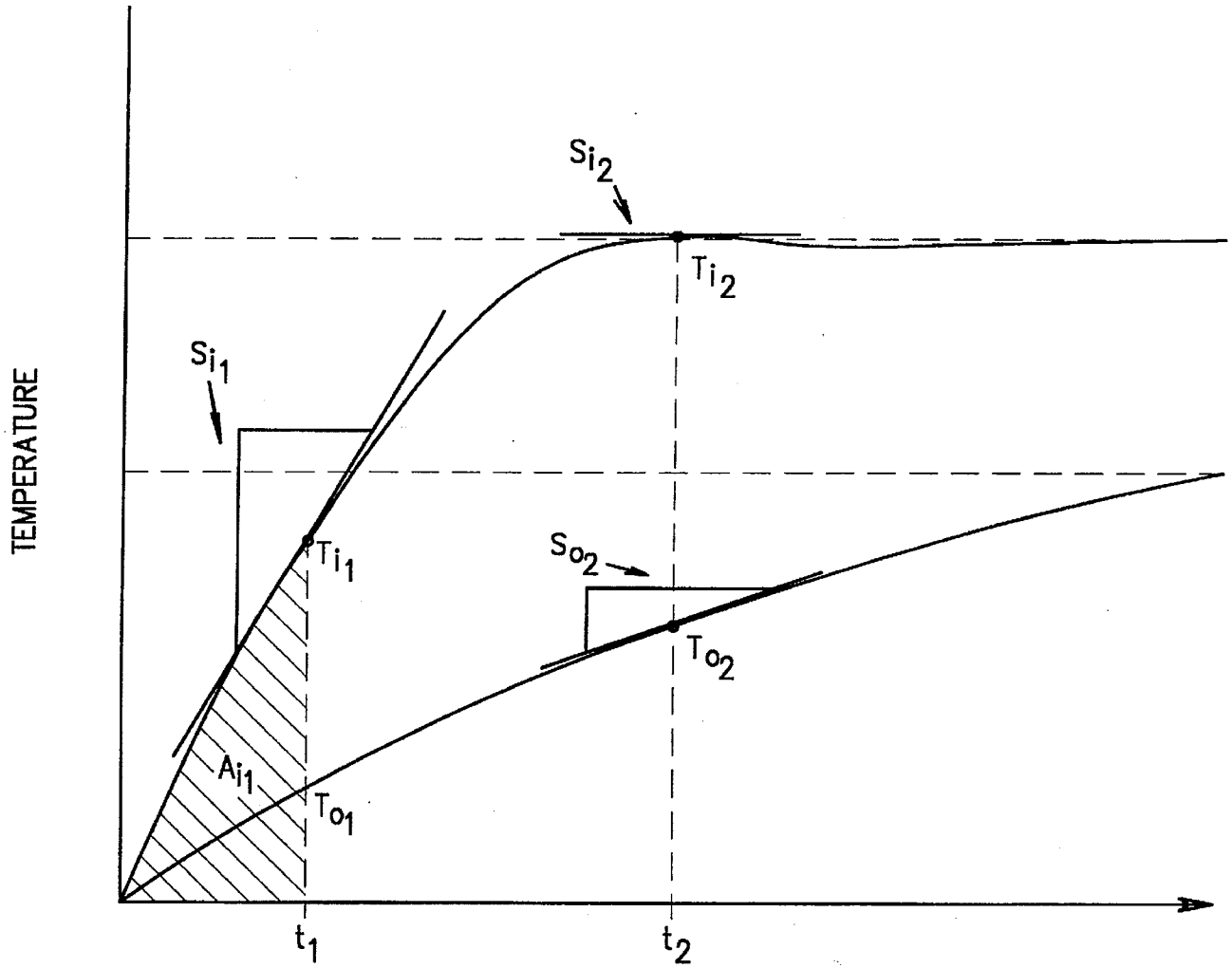
FIG. 5 is a graph illustrating setpoints and idealized curves utilized in the most preferred control scheme of the present invention for controlling drying temperature.

FIG. 4 is a flowchart illustrating this most preferred control scheme. The control scheme utilizes a garment temperature setpoint "$T_i$" and an exhaust temperature setpoint "$T_o$". The control scheme also utilizes idealized time curves for both the garment temperature and the exhaust temperature over the course of the drying cycle. These are illustrated in FIG. 5. These values and curves are entered into a memory storage device, such as a microprocessor-based programmable controller that can be utilized for the previously noted controller 70.

Referring to FIGS. 4 and 5, implementation of this control scheme is as follows. Upon entry of all setpoints and idealized curves, and initiation of the dryer operation, the controller executes a first control step in which the measured garment temperature $T_{ir}$ is compared to the garment temperature setpoint $T_i$. Additionally, the measured dryer exhaust temperature $T_{exh}$ is compared to the exhaust setpoint $T_o$. If the measured garment temperature $T_{ir}$ is greater than or equal to the garment temperature setpoint $T_i$, or if the measured dryer exhaust temperature $T_{exh}$ is greater than or equal to the dryer exhaust temperature setpoint $T_o$, then the control scheme reduces the flow of gas to the dryer heater. If however, the measured garment temperature $T_{ir}$ is less than the garment temperature setpoint $T_i$, and the measured dryer exhaust temperature $T_{exh}$ is less than the dryer exhaust setpoint $T_o$, then another comparison is performed.

In this next step, the rate of temperature increase of the measured garment temperature, i.e. $T_{ir}$/time, is compared to the slope of the idealized garment temperature curve at the particular point in time, i.e. $S_{i1}$ or $S_{i2}$. Similarly, the rate of temperature increase of the measured dryer exhaust, i.e. $T_{exh}$/time, is compared to the slope of the idealized dryer exhaust temperature curve at the corresponding point in time in the drying cycle, i.e. $S_{o1}$ or $S_{o2}$. If either (i) the measured rate of increase in the garment temperature $T_{ir}$/time is greater than or equal to the slope of the idealized garment temperature curve $S_i$, or (ii) the measured rate of increase in the dryer temperature exhaust $T_{exh}$/time is greater than or equal to the slope of the idealized dryer exhaust temperature curve $S_o$, the flow of gas to the dryer heater is reduced. If however, both $T_{ir}$/time is less than $S_i$, and $T_{exh}$/time is less than $S_o$, then another comparison is performed.

In this next comparison, the totalized value of the measured garment temperature from the beginning of the dryer operation $T_{ir}$*time, is compared to the integrated value or area Under the idealized garment temperature curve from the beginning up to the particular point in time, such as $A_{i1}$ or $A_{i2}$. Also, the totalized value of the measured dryer exhaust temperature from the beginning of the dryer operation $T_{exd}$*time, is compared to the area under the idealized dryer exhaust temperature curve up to that particular point in time, i.e. $A_{o1}$ or $A_{02}$. If either of the measured totalized values $T_{ir}$*time or $T_{exh}$*time, is greater than or equal to its corresponding $A_i$ or $A_o$, the flow of gas to the dryer heater is reduced. If both the measured totalized values $T_{ir}$*time and $T_{exh}$*time are less than their corresponding $A_i$ or $A_o$ values, the control scheme then increases the flow of gas to the dryer heater.

In a variation of this most preferred control scheme, two infrared sensors are utilized to measure garment temperature. The signals from the two infrared sensors can be averaged or otherwise combined to provide the previously noted $T_{ir}$ signal.

In addition to providing a strategy for very accurately controlling the temperature within the dryer, the present invention also provides control schemes for determining drying cycle completion. Although not wishing to be bound to any particular control scheme, the present inventor contemplates two control strategies for dryer systems utilizing infrared sensors. A first technique for determining drying cycle completion is accomplished by comparing the rate of temperature increase of the garments being dried to one or more of the following: (i) a preset drying rate value, (ii) a drying rate value which is set according to current dryer load conditions, and/or to (iii) a previous drying rate of a similar dryer load or several past loads. The preset drying rate value would be entered into a storage device in association with the control system. The second type of value, i.e., a drying rate value which is set according to current dryer load conditions, is a value that is wholly or partially determined by the control system based upon characteristics of the current dryer load. The third type of value, i.e. a drying rate value determined by previous drying rates of previous loads, is wholly or partially determined by the control system using data archived from previous drying loads.

This first technique for determining drying cycle completion is based upon the principle that if the introduction of heat to the dryer is constant, the temperature of the garments during the drying cycle increases at a greater rate once water retained in the garments being dried has been driven off since energy from the heat input no longer results in evaporation of moisture. Instead, the heat input causes an increase in the temperature of the garments. Such temperature increase is measured by the infrared sensor(s) according to the present invention. Once the rate of temperature increase, as measured by one or more infrared sensing devices, reaches or exceeds one or more of the three previously described drying rate values (i)–(iii), dryer cycle completion or indication thereof would occur.

A second technique for determining dryer cycle completion is to monitor garment temperature as indicated or measured by one or more infrared sensors 60. Once the measured garment temperature reaches or exceeds a preset temperature value, dryer cycle completion or indication thereof occurs. It is also contemplated that these control techniques could be employed together, or in combination with other control schemes.

EXPERIMENTAL

COMPARISON OF DRYNESS DETERMINATIONS

In order to confirm that conventional drying controls which rely upon a combination of humidity probes and inlet and outlet airstream temperature sensors are relatively inaccurate, and thus are a prime cause for the problems of overdrying and underdrying, measurements were made of garment temperatures during a typical drying cycle according to the prior art. Although garment temperatures were also measured using infrared sensors, such sensors were not used to control dryer temperature or heat input, or any other parameter of the drying process in the first set of trials.

Several commercially available industrial dryers, i.e., 200 and 400 pound dryers, were operated through normal drying cycles with varying loads. The tests were run using wet towels as the medium to be dried. The dryer controls were set to 625° F. inlet temperature and 220° F. exhaust temperature.

Figure 6:
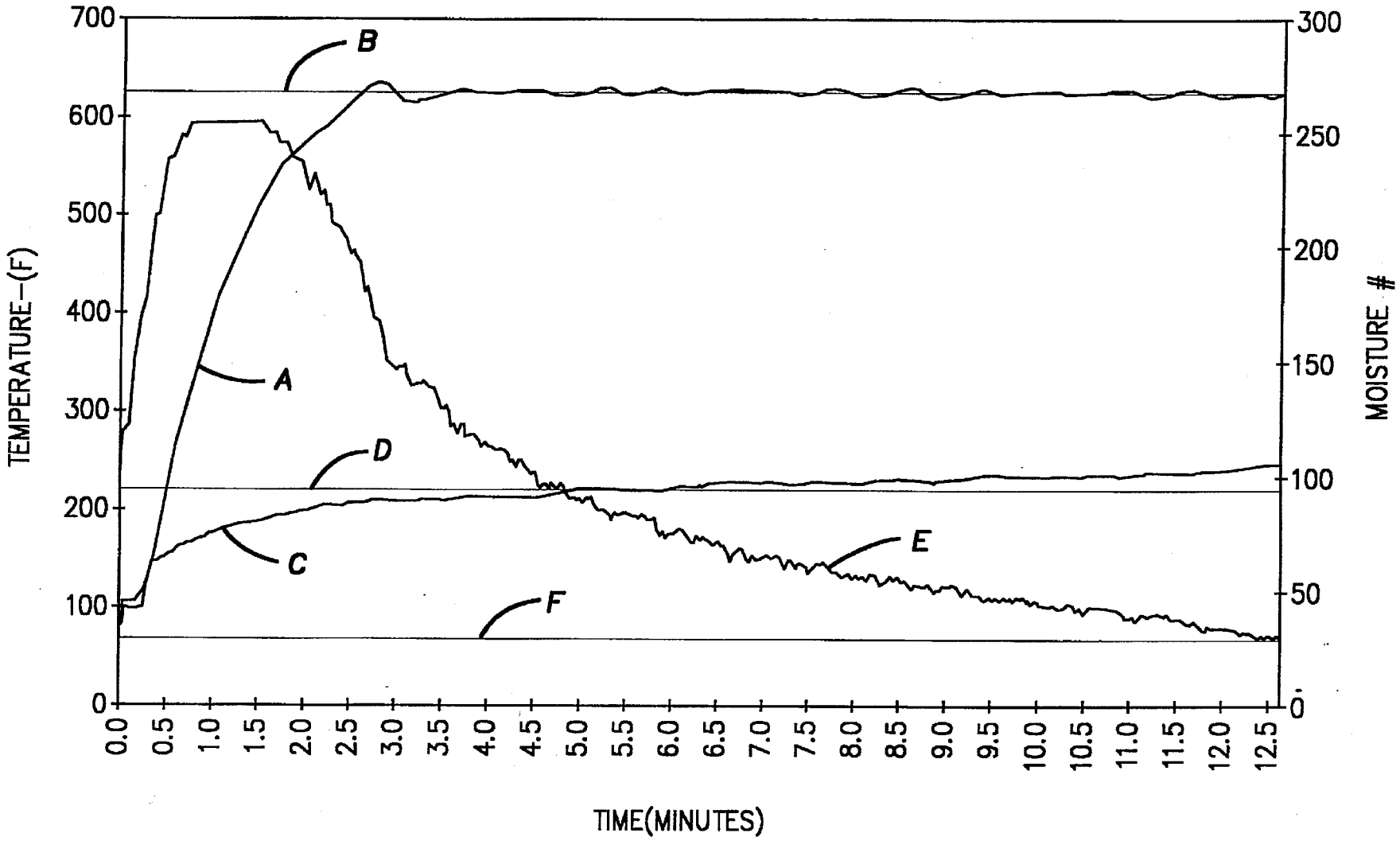
FIG. 6 is a graph illustrating temperature and moisture parameters as a function of time in a drying process utilizing a conventional dryer control system.

FIG. 6 illustrates temperature readings measured in a first set of trials by temperature sensors disposed on inlet and outlet airstreams and a moisture probe during 12½ minutes of a drying cycle. Accordingly, when heat was applied, the inlet temperature A rose and was maintained at the inlet temperature set point B. Similarly, exhaust air temperature C rose toward the exhaust temperature set point D. Although the actual garment temperatures measured by infrared sensors are not shown in FIG. 6, the exhaust air temperature C and actual garment temperatures rose in relative proportion to each other with a 40° F. difference being the maximum variation between the two. The moisture probe E measured the amount of moisture in the exhaust air. As is evident from FIG. 6, the measured moisture level E initially rose, and then gradually decreased as the moisture was removed from the garments. When the moisture probe reached its set point F, the drying cycle ended.

Although garment temperature is represented proportionally by the exhaust air temperature C, the actual difference between the garment temperature and the exhaust air temperature varied from 0° to 40° F. Thus, conventional dryness determinations based upon exhaust temperature, or humidity probes which are compensated by exhaust temperature measurements, can affect the dryness determination calculation by as much as 25 percent. Thus, moisture removal calculations can be improved by about 25 percent by using the infrared temperature sensor(s) according to the present invention to determine actual garment temperature instead of employing exhaust temperature measurements that only provide an indication of garment temperature.

Figure 7:
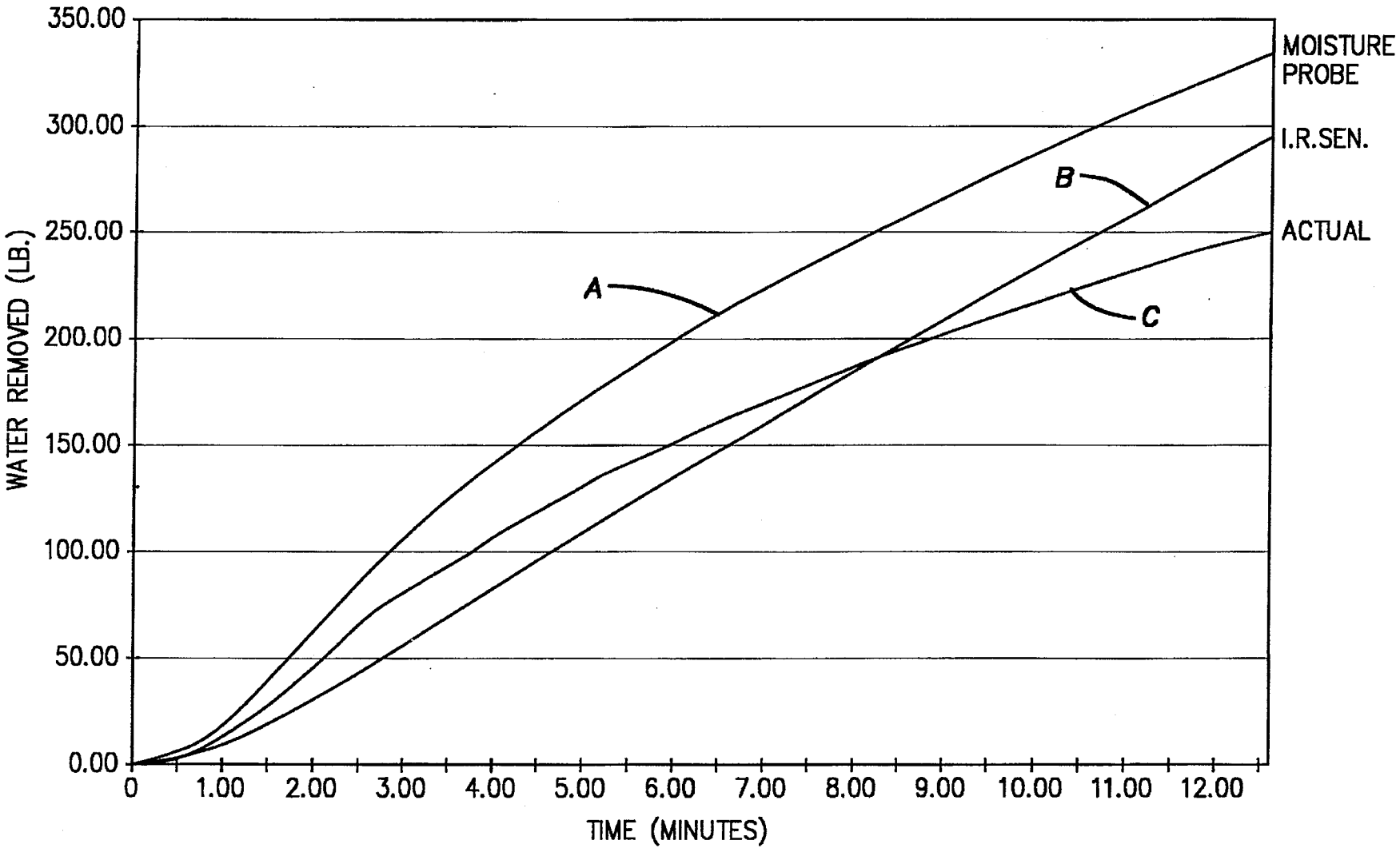
FIG. 7 is a graph illustrating water removal as a function of time in a drying process utilizing the temperature sensing system of the present invention.

FIG. 7 compares prior art moisture removal calculations utilizing moisture probe readings A to calculations based upon actual garment temperatures measured by infrared sensors B. Calculations were based upon a drying trial performed in a commercial 400 pound dryer, drying 400 pounds of towels having an initial 65 percent water. retention level. The dryer controls were set to 625° F inlet temperature and 220° F. exhaust temperature.

Using prior art techniques, i.e. measurements from inlet and outlet temperature sensors and a moisture probe, the amount of water removed was calculated over the drying cycle and designated as line A in FIG. 7. The same dryness determinations were made using the infrared sensor according to the present invention and shown in FIG. 7 as line B. Additionally, the actual water removed was determined by weighing the garments, and designated in FIG. 7 as line C.

In comparing the prior art dryness determination method (line A), and the dryness determination method of the present invention (line B), to the actual water removed (line C), it is evident that dryness determinations using the infrared sensor (line B) are significantly more accurate than the prior art method (line A). As illustrated in FIG. 7, after completion of the drying cycle (after 12.5 minutes), the actual moisture removed was 250 pounds. The amount of water removal calculated using the moisture probe was 332 pounds. The value calculated using the infrared sensor was 292 pounds.

CONTROLLING DRYING TEMPERATURES

The following discussion is with regard to controlling the drying temperature provided within a drying device. Numerous experiments were conducted in which the values W (weight of water removed) and Q (heat input to dryer) were calculated utilizing various measurements from sensors in a dryer during a 14½ minute drying cycle. The dryer utilized in the testing contained numerous sensors that provided input measurement values employed in calculating W and Q. The dryer comprised a temperature sensor at the flame in the dryer heater unit that provided a measurement of flame temperature, referred to as $T_{in}$. The dryer comprised four temperature sensors located at opposite corners of the drying chamber which were averaged together to provide an average measurement of the temperature within the drying chamber, referred to herein as $T_{avg}$. The dryer also comprised an infrared sensor that provided a measurement of the temperature of garments as they dried, referred to herein as $T_{ir}$. The dryer additionally contained a temperature sensor at the dryer exhaust that provided a measurement of the temperature of air exiting the dryer, designated as $T_{exh}$. The dryer further contained a humidity probe located within the drying chamber that provided a measurement of humidity or moisture level within the drying chamber. The dryer also contained a measuring device on the gas line to the dryer heating line that measured the pressure of gas flowing to the burner. Also provided on the gas line was a device for measuring the amount, by volume, of gas flowing to the burner.

A total of nine drying trials were conducted in which the ratio $Q_{actual}/W_{actual}$ was compared to other ratios of Q/W, each ratio arrived at by utilizing different combinations of measurement inputs for determining Q and W.

A total of nine drying trials were conducted in which the ratio of the actual heat supplied per pound of water removed, designated $Q_{actual}/W_{actual}$, was compared to other ratios of Q/W, each ratio arrived at by utilizing a different combination of temperature inputs for determining Q and W. $Q_{actual}$ was determined by measuring the amount of gas actually supplied to the dryer heater. $W_{actual}$ was determined by weighing the wet garments at the beginning of the dry cycle and the dried garments at the end of the cycle. As set forth in Table I below, Q was determined three ways. In the first approach, Q was calculated utilizing $T_{in}$ for $T_2$, and the ambient air temperature $T_{amb}$ for $T_1$ in the calculations for Q. In a second approach, Q was calculated utilizing $T_{avg}$ for $T_2$ and $T_{amb}$ for $T_1$. In a third approach, Q was calculated based upon pressure readings of the gas flowing to the dryer heater.

Referring further to Table I, it will be seen that W was determined five different ways. In a first approach, W was calculated utilizing $T_{in}$ for $T_1$ and $T_{exh}$ for $T_2$. Secondly, W was calculated using $T_{avg}$ for $T_1$ and $T_{exh}$ for $T_2$. Thirdly, W was calculated by using $T_{in}$ for $T_1$ and $T_{ir}$ for $T_2$. In the fourth approach, W was calculated by utilizing $T_{avg}$ for $T_1$ and $T_{ir}$ for $T_2$. In the fifth approach, W was determined based upon measurements from a moisture probe. The $Q_{actual}/W_{actual}$ and various other ratios of Q/W for each of the nine trials were then averaged, and are set forth in Table I below. All values for Q/W in the table are expressed as BTU's per pound of water removed.

TABLE I

Q/W (BTU Used vs. Water Removed)
Average of Theoretical Methods vs. Actual

| Average % deviation from Actual | Q (based on $T_{in}$) | Q (based on $T_{avg}$) | Q (based on nozzle pressure) | Q (actual) |
|---|---|---|---|---|
| W i/exh | 1,830 | 1,478 | 1,012 | 3,966 |
| (based on $T_{in}/T_{exh}$) | 54% | 63% | 74% | |
| W avg/exh | 2,669 | 2,152 | 1,474 | |
| (based on $T_{avg}/T_{exh}$) | 33% | 46% | 63% | |
| W i/ir | 2,364 | 1,908 | 1,305 | |
| (based on $T_{in}/T_{ir}$) | 40% | 52% | 67% | |
| W avg/ir | 3,892 | 3,140 | 2,149 | |
| (based on $T_{avg}/T_{ir}$) | 2% | 21% | 46% | |
| W moist | 1,927 | 1,553 | 1,061 | |
| (based on moist. probe) | 51% | 61% | 73% | |

Note:
The numbers presented in Table I (BTU/pound of water removed) include the BTU received from the air It is evident from Table I that a very accurate determination of the BTU's used per pound of water removed in a dryer, i.e. represented by the ratio Q/W, can be obtained by utilizing $T_{avg}$ for $T_1$ and $T_{ir}$ for $T_2$ to calculate the denominator W; and utilizing $T_{in}$ for $T_2$ and $T_{amb}$ for $T_1$ to calculate the numerator Q. That is, the ratio of Q/W as determined in accordance with the present invention, was only about 2% from the actual amount of heat used per pound of water removed, i.e. $Q_{actual}/W_{actual}$ as determined from a volumetric flow meter located directly on the gas line and measuring the amount of water actually removed. It is surprising and remarkable that such accurate determination of energy input can be determined merely by utilizing a particular combination of sensors that measure temperature in the drying system.

Although the invention has been described in relation to specific embodiments thereof, it will become apparent to those skilled in the art that numerous modifications and variations can be made within the scope and spirit of the invention as defined in the attached claims.

What is claimed is:

1. A rotatable drum dryer comprising:

a dryer unit including a rotatable drum for receiving and tumbling moist or wet articles to be dried, a heating device for heating said articles disposed in said drum, a dryer air inlet, a dryer air outlet, and a blower unit for passing air over said articles in said drum;

an infrared sensing device that provides a measurement of the temperature of articles in said drum, said infrared sensing device disposed proximate the axis of rotation of said drum.

2. The drum dryer of claim 1 wherein said infrared sensing device provides at least one control signal representative of said temperature of said articles in said drum.

3. The drum dryer of claim 2 wherein said at least one control signal is an analog signal.

4. The drum dryer of claim 2 wherein said at least one control signal is a digital signal.

5. The drum dryer of claim 1 wherein said infrared sensing device provides a visual indication of said temperature of said articles in said drum.

6. The drum dryer of claim 1 further comprising:

a second infrared sensing device that provides a measurement of the temperature of articles in said drum.

7. The drum dryer of claim 6 wherein both said infrared sensing device comprise infrared sensors, and both said sensors are disposed on said dryer at locations approximately along the axis of rotation of said drum.

8. The drum dryer of claim 1 further comprising:

a first temperature sensor device exposed to air in said dryer air inlet.

9. The drum dryer of claim 1 further comprising:

a first temperature sensor device exposed to air in said dryer air outlet.

10. A control system for governing the operation of a dryer having a rotatable drum, a dryer air inlet, and a dryer air outlet, said control system comprising:

a temperature sensor device exposed to air in said dryer air inlet, wherein said temperature sensor device provides a first control signal;

at least one infrared sensor device having a view of the interior of said drum, wherein said at least one infrared sensor device provides a second control signal, said at least one infrared sensor device disposed at a location generally along the axis of rotation of said drum; and a controller for governing the operation of said dryer based upon at least said first and second control signals.

11. The control system of claim 10 wherein said control system comprises two infrared sensor devices.

12. The control system of claim 10 further comprising:

a second temperature sensor device exposed to air in said dryer air outlet, wherein said second temperature sensor device provides a third control signal.

13. The control system of claim 11 further comprising:

a second temperature sensor device exposed to air in said dryer air outlet, wherein said second temperature sensor device provides a third control signal.

* * * * *

UNITED STATES PATENT AND TRADEMARK OFFICE

CERTIFICATE OF CORRECTION

PATENT NO. : 5,651,192

DATED : July 29, 1997

INVENTOR(S) : Steven A. Horwitz

It is certified that error appears in the above-indentified patent and that said Letters Patent is hereby corrected as shown below:

Column 4, line 21, delete "once" and insert therefor --Once--.

Column 4, line 43, delete "know" and insert therefor --known--.

Column 6, line 24, delete "Under" and insert therefore --under--.

Signed and Sealed this

Ninth Day of December, 1997

Bruce Lehman

*Attest:*

BRUCE LEHMAN

*Attesting Officer*

*Commissioner of Patents and Trademarks*